United States Patent [19]

Linder et al.

[11] 4,229,147

[45] Oct. 21, 1980

[54] ROTARY POSITIVE-DISPLACEMENT PUMP

[75] Inventors: Ernst Linder, Mühlacker; Helmut Rembold, Stuttgart; Walter Teegen, Waiblingen; Achill Kessler, Sindelfingen; Roland Ehmann, Abstatt, all of Fed. Rep. of Germany

[73] Assignee: Robert Bosch GmbH, Stuttgart, Fed. Rep. of Germany

[21] Appl. No.: 4,232

[22] Filed: Jan. 17, 1979

[30] Foreign Application Priority Data

Feb. 23, 1978 [DE] Fed. Rep. of Germany ..... 2807721

[51] Int. Cl.[3] ..... F04B 49/00

[52] U.S. Cl. ..... 417/283; 417/310; 418/23

[58] Field of Search ..... 418/23, 27; 417/283, 417/284, 223

[56] References Cited

U.S. PATENT DOCUMENTS 4,050,263 9/1977 Adalbert et al. ..... 418/23 X

FOREIGN PATENT DOCUMENTS 852776 11/1960 United Kingdom ..... 417/223

*Primary Examiner*—Philip R. Coe

*Attorney, Agent, or Firm*—Edwin E. Greigg

[57] ABSTRACT

A rotary positive-displacement pump in which the vane or vanes separating the chambers are locked in the inner dead center point after a certain outlet pressure has been attained, in order to shut off the pump. A corresponding locking apparatus has a detent which assures that each vane is locked in a form-locking manner in the position which shuts off the pumping action. Preferably, the locking apparatus has an overstroke step by means of which it is assured that each vane is constantly held at an increased distance from its sliding surface so that friction and impact noises are positively avoided.

12 Claims, 13 Drawing Figures

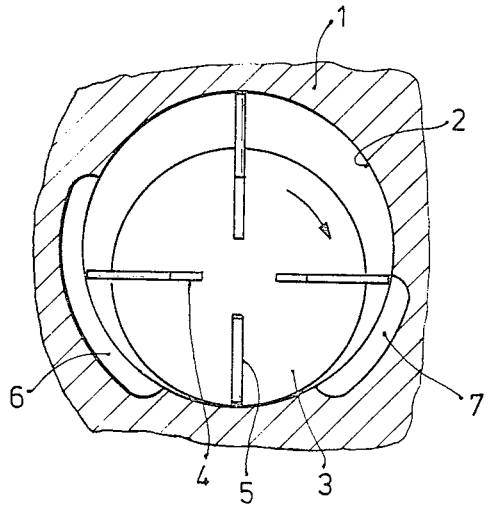
Fig.1
Fig.2
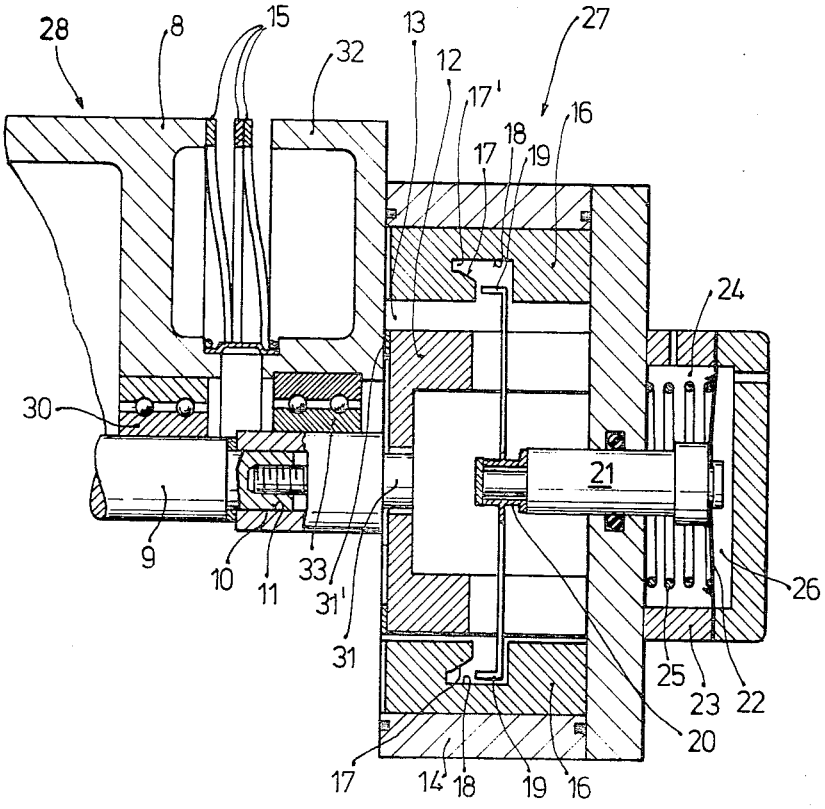

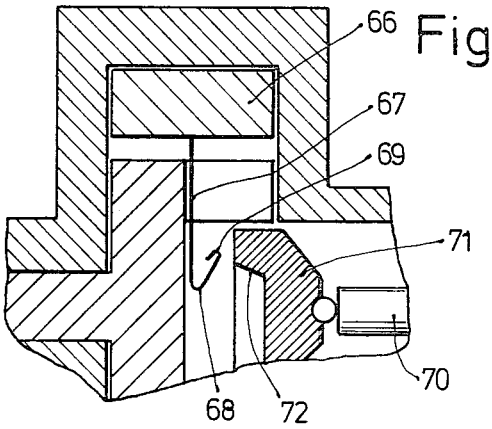
Fig.9
Fig.10
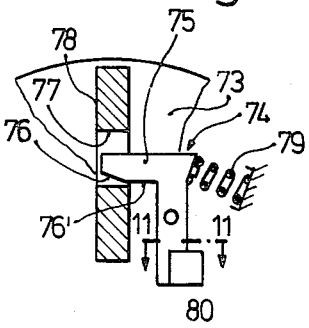
Fig.11
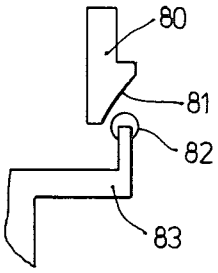
Fig.12
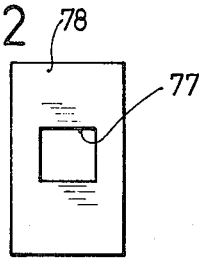
Fig.13
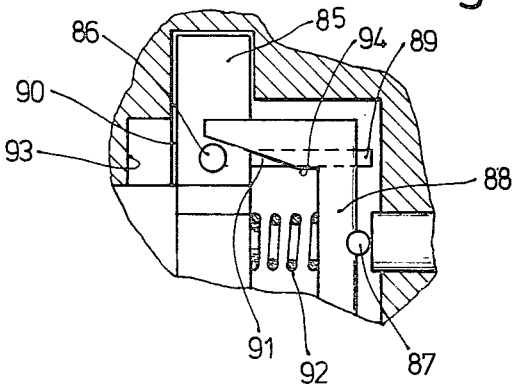

ROTARY POSITIVE-DISPLACEMENT PUMP

BACKGROUND OF THE INVENTION

The invention relates to a rotary positive-displacement pump of the type such as is shown in U.S. Pat. No. 3,904,321.

Such pumps are inserted as air pumps and generally run without lubrication. At low rpm, the lubrication problem may be solved by the application of carbon or graphite or molybdenum disulfide; but such means of "dry lubrication" are not sufficient for high rpm.

In order to shut off the pumping action, the known structural type of pump utilizes the pressure generated by the pump, with the vanes being locked in accordance with the outlet pressure. Such a design has the disadvantage, however, that the piston rolling within a housing bore contacts the vane, locked in its retracted position, once per revolution. This produces friction, which is a particular problem at higher rpm. The intermittent noises which thereby arise are also disturbing.

OBJECT AND SUMMARY OF THE INVENTION

The rotary positive-displacement pump of the invention has the advantage over the prior art in that it is possible to operate the pump at higher rpm levels as well. It may then be driven, for example, by the generator of a motor vehicle which can rotate up to 15,000 rpm. The pump advantageously operates for only short periods at such a high rpm level, so that the rolling piston together with its vane or vanes completes its revolution empty. At that time, the vanes are completely withdrawn from the contact surface; that is, they have no further contact with their contact surface. The positive-displacement pump is primarily intended for installation in motor vehicles equipped with Diesel engines. There, it serves to create subpressure for a vacuum brake amplifier and is directly driven by the generator of the vehicle. This has the advantage that as a result of the high rpm of the generator, which is approximately twice as high as the engine rpm driving it, the pump may be of relatively small size. It is also possible that during subsequent installations of the pump in a presently installed generator, only very few changes are required. This makes mass production significantly easier.

The invention will be better understood as well as further objects and advantages thereof become more apparent from the ensuing detailed description of preferred embodiments taken in conjunction with the drawings.

BRIEF DESCRIPTION OF THE DRAWINGS

FIG. 1 is a view, partially in section, of a rotary positive-displacement pump constructed in accordance with the invention;

FIG. 2 is a sectional view showing the installation of the pump of the invention together with a generator and a vane-locking apparatus;

FIG. 9 is a sectional view of a sixth embodiment of the locking apparatus incorporated with the invention;

FIG. 10 is a sectional view of a seventh embodiment of the locking apparatus incorporated with the invention;

FIG. 11 is a sectional view taken along the line 11—11 of FIG. 10 in the direction of the arrows;

FIG. 12 is a side elevation view of a vane in accordance with FIG. 10; and FIG. 13 is a sectional view of an eighth embodiment of a locking apparatus incorporated with the invention.

DESCRIPTION OF THE PREFERRED EMBODIMENTS

Figure 3:
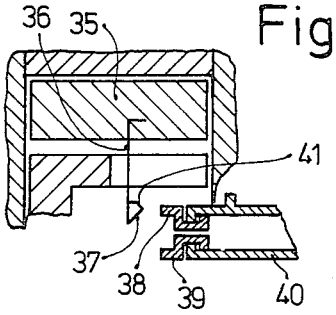
FIG. 3 is a sectional view of a second embodiment of the locking apparatus incorporated in FIG. 2.

Referring now to FIG. 1, there is shown a rotary positive-displacement pump constructed in accordance with the invention and embodied as a vane pump. The pump includes a housing 1 having a bore 2, on the wall of which a rotatable piston 3 is arranged to roll. This piston 3 is referred to henceforth as a rotor. The rotor 3 has four slots 4, into each of which one vane 5 is inserted. On the left side of the pump of FIG. 1, there is provided an intake groove 6 and on the right side an outlet groove 7. The pump functions as an air pump. The pump draws in air through the intake groove 6 and exhausts the air toward the outlet groove 7. Thus, as a vacuum pump, it creates a vacuum on the intake side, which is intended to be utilized as an auxiliary force, for example, for the vacuum brakes of a motor vehicle.

FIG. 2 shows, on the left, a housing end 8 of a generator 28 of a motor vehicle. The conventional single-row ball bearing of a generator is replaced by a double-row bearing 30 in order to take on the additional loads arising from a pump 27 that is associated therewith. A rotor 12 is connected, in either a force-locking or form-locking manner, by means of a hollow screw 31 to an extended rotor shaft 9. A pump mounting flange 32 is centered with respect to the rotor 12 through a further bearing 33. This bearing 33 is shown as a ball bearing, but it can also be a roller bearing or a needle bearing. The mounting of the flange 32 on the generator 28 is accomplished by means of leaf springs 15. The setting of the air gap between the rotor 12 and the front face of the mounting flange 32 is accomplished by means of a spacer collar 31'.

The rotor 12 is rotatable within a housing bore 13 of a pump housing 14 which is connected to the mounting flange 32. There are four vanes 16 supported within the rotor 12, only two of which are illustrated.

Each vane 16 has an interior recess 18 which has an oblique face 17 and a gripper 19 is arranged to project into the recess 18 for engagement therewith. Four spring grippers 19 are mounted on a casing 20 at equal angular distances, and the casing 20 is axially movable by means of a rod 21 disposed coaxially with a hollow threaded tang 11. This axial movement is produced by a diaphragm piston 22 of a work cylinder 23, which encloses a work chamber 24 having a return spring 25 as well as an exterior air chamber 26. Components 19 through 25 comprise a locking apparatus for the pump 27.

When the pump 27 is operating, the vanes 16 can move freely at first in order to be able to perform the pumping process by means of contact with the wall of the bore 13. In this manner, at rpm levels which can reach up to 15,000 rpm, a sufficient vacuum is created for the multiple actuation of the vacuum brake of the vehicle. This suction also contacts the diaphragm piston 22, and when it is of sufficient magnitude, the piston 22 overcomes the force of the return spring 25. The rod 21 with the casing 20 and the four grippers 19 move to the left. At that time, the grippers 19, as the vanes each reach their inner dead center point, contact the oblique face 17 and draw each vane 16 past its inner dead center point farther toward the inside, so that each vane completely loses its contact with the bore wall 13. At the end of the oblique faces 17, a detent is formed by an axial step 17'. In this manner, all four vanes 16 are grasped one after the other in the course of one revolution, then are drawn back and locked.

By means of the locked vanes 16, not only is the functioning of the pump interrupted, but it is also assured that the vanes 16 no longer contact the bore wall 13. Thus, friction and wear are avoided. All the vanes 16 remain in this position until the auxiliary vacuum force is at least partially spent. Then the return spring 25 displaces the rod 21 with the casing 20 and the grippers 19 back toward the right. The grippers 19 slide out of the recess 18, and the vanes 16 can again move freely. The pump then functions again.

FIGS. 3–13 illustrate additional embodiments of a locking apparatus which are somewhat different from each other.

FIG. 3 shows a vane 35, which carries a gripper 36 secured to the vane. At the free end of each gripper 36, there is a wedge piece 37, which is arranged to project into the corresponding recess 38 of a casing insert 39. The casing insert 39 is inserted rotatably into a casing 40, which is comparable to the rod 21 in that it can be axially displaced. An oblique face 41 on each wedge piece 37 serves as an abutment surface similar to the oblique face 17 in the embodiment according to FIG. 1, and accomplishes a withdrawal of the vane 35 past the lower dead center position. The inner end of the oblique face 41 forms a detent. The operation of the locking apparatus of FIG. 3 proceeds in the same manner as the embodiment of FIG. 2.

Figure 4:
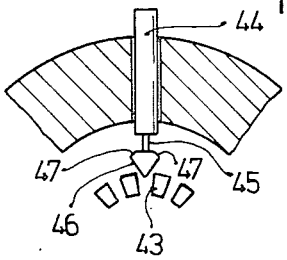
FIG. 4 is a front view similar to FIG. 3 of a third embodiment of the locking apparatus of FIG. 2.
Figure 5:
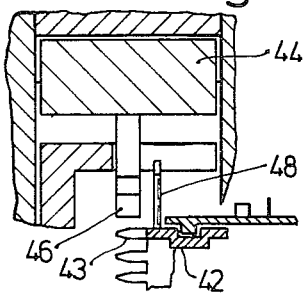
FIG. 5 is a sectional side view of the locking apparatus of FIG. 4.

In FIGS. 4, 5, further embodiments of a locking apparatus are shown. In FIGS. 4, 5, a casing insert 42 is provided which incorporates longitudinal slots 43 therein. The fingers of the casing insert 42 which have been stopped are of a yielding construction and have a front face which is conically tapered so that they can also slip over the vane which, at this point. has just attained its bottom dead center position. Each vane 44 has a tang 45 with a wedge-shaped foot 46. Each wedge-shaped foot 46 has, in addition to its wedge shape, further oppositely directed oblique faces 47 that function as abutment surfaces. In such a design, a fixed association of vane 44 and longitudinal slot 43 is necessary. For this reason, the rotatably supported casing part 42 is coupled by means of a pin 48 with the rotor 12. In this embodiment as well, the oblique faces 47 assure a positive withdrawal of the vane 44. Thus, as is clearly shown in these views, the detent is formed on the tang 45.

Figure 6:
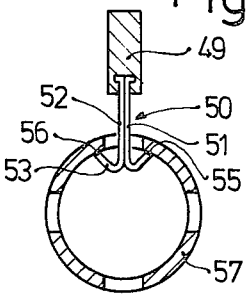
FIG. 6 is a sectional view of a fourth embodiment of a locking apparatus incorporated with the invention.

FIG. 6 illustrates a further development of the embodiment of FIGS. 4 and 5 with a vane 49 having a tang 50 of different construction. This tang 50 comprises two spring pieces 51 and 52, the free ends 53 and 54 of which are elastically spread apart into a V-shaped configuration. This V-shaped configuration is provided to permit the tang to project into the casing insert longitudinal slot as a detent in engagement therewith. Oblique faces 55 and 56 permit the supplementary withdrawal of the vane 49.

The embodiment of FIG. 6 is a reversal of the construction of the embodiment of FIGS. 4 and 5, because in the embodiment of FIG. 6, the casing insert 57 can be rigid. The vane 49 is shown in its locked position.

Figure 7:
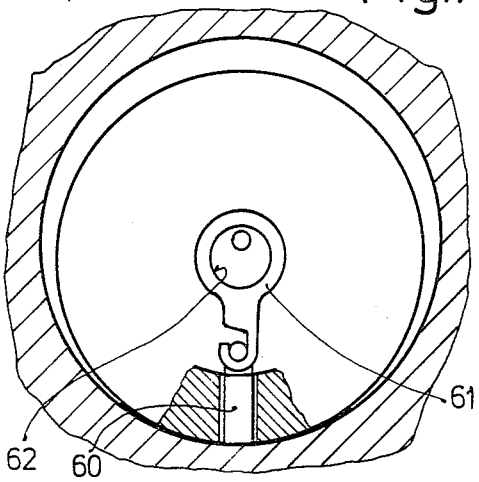
FIG. 7 is a front sectional view of a fifth embodiment of the locking apparatus incorporated with the invention.
Figure 8:
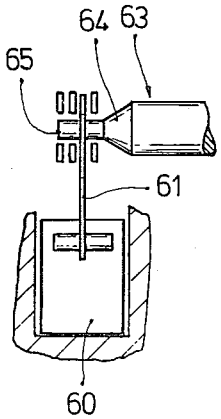
FIG. 8 is a sectional side view of the locking apparatus of FIG. 7.

In the embodiment of FIGS. 7 and 8, in contrast to the constructions already described, a positive guidance for the vanes is provided. At the inner end of each vane 60, there is a tongue 61 attached as a gripper; the tongue 61 is provided with a bore 62. An axially adjustable rod 63 is provided with an intermediate piece 64 in the form of a truncated cone and with a tapered end portion 65. When the pump is in the supply mode, the rod 63 proj-o62 so that
only the tapered end 65 is overlapped.

In order to switch off the pump supply, the rod 63 is pressed toward the left and moved further into the tongue bore 62. Then the vane 60 is locked in its inner dead center position through the frusto-conical intermediate piece 64 and is mounted on the large diameter portion of the rod 63 as a detent. Then, the vane 60 is lifted from the wall of the housing bore, and there is no further friction.

FIG. 9 shows an embodiment in which a vane 66 has an elastic gripper 67. An inner portion 68 of the gripper 67 is bent at a V-shaped angle and bent again by 180° at its end area 69. A bell 71 is disposed between an axially movable rod 70 and the gripper 67 and this bell has an oblique face 72 which is of annular form.

When the rod 70 moves to the left, the oblique face 72 grasps the end area 69, presses the gripper 67 laterally against the rotor, and locks the vane 66 in the bottom dead center position. When the rod 70 moves further, the free leg of the V-shaped portion 68 of the gripper 67 functions as an elbow lever and draws the vane 66 still farther back. Thus, the vane 66 is provided with a detent at this point. When the rod 70 returns, the locking apparatus releases; however, the release can also be reinforced by means of a yieldable sleeve, not shown.

FIGS. 10, 11 and 12 are directed to a design with a lever 74 pivotally supported in a rotor 73. The lever 74 has a gripper 75 with an oblique face 76. The gripper 75 engagingly projects into a window 77 (as shown in FIG. 12) of a vane 78 in the final position shown in FIG. 10, and has a detent 76' in the form of a straight-line surface. In the direction of engagement, the lever 74 is subjected to the force of a spring 79, which is supported on the rotor 73. The other end 80 of the lever 74 is shown in FIG. 11. The lever end 80 has an abutment surface 81 for a roller 82, which is supported on an angular extension 83 of the actuation rod. In the position illustrated in FIG. 10, the vane 78 is locked in the bottom dead center position. By means of the oblique face 76 on the gripper 75, the vane 78 is lifted up and retained by means of the straight-line-surface detent 76'.

In the embodiment of FIG. 13, a locking apparatus is shown in which the vanes are always positively guided. A roller 86 is provided on each vane 85. The actuation rod pressures, through a ball means 87, onto a bell member 88, which is coupled through at least one guide pin 89 to a rotor 90. The bell member 88 has annular oblique face 91 and is supported with respect to the rotor 90 by a return spring 92. On the other side, the rotor 90 has a recess 93 into which a portion of the bell member 88 is moved. When the bell member 88, which contacts the actuation rod, is axially displaced, the roller 86 rolls downward along the oblique face 91, and the vane 85 is drawn inward. After the vane stroke has terminated, the oblique surface 91 includes an axially extending contour which functions as a detent 94 for the vane 85. In this position, the vane 85 is completely lifted and friction-free.

After the idling phase has ended, the actuation rod again releases the bell member 88, and the return spring 92 presses the bell member 88 back again to the right. Then, the vane 85 is again free and the pump can function again.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A rotary positive-displacement pump of the type generating a vacuum comprising, in combination, a housing having a bore and including an inlet side and an outlet side, a rotatable piston eccentrically disposed within said housing bore for rolling engagement therewith, at least one vane in said housing for separating said inlet side from said outlet side and means responsive to supply pressure for locking said vane in a position which shuts off the pumping action of said pump, said locking means including a detent for locking said vane in said position for shutting off the pumping action.

2. A positive-displacement pump in accordance with claim 1 wherein said vane includes an axially extending contour means terminating movement of the vane.

3. A positive displacement pump in acordance with claim 2 wherein said locking means includes a gripper, said gripper being bent substantially into a V-shaped configuration and having one leg for cooperation with said detent, said one leg providing an elbow lever action.

4. A positive-displacement pump in accordance with claim 3 including a plurality of vanes, a plurality of grippers disposed about a common center, an axially movable member, responsive to supply pressure, said plurality of grippers coupled to said axially movable member, the locking means responsive to the connection with said vanes can be turned off.

5. A positive-displacement pump in accordance with claim 4 wherein said grippers are secured to said axially movable member responsive to supply pressure, said grippers being coupled with said vanes.

6. A positive-displacement pump in accordance with claim 4 wherein each of said grippers is mounted on the vanes, said grippers being coupled with said axially movable member which is responsive to supply pressure.

7. A positive-displacement pump in accordance with claim 6 wherein each of said grippers is provided with a passageway hole in the region of the axially movable member responsive to supply pressure, said axially movable member being provided with a tapered portion and a jacket surface of large diameter connected with the tapered portion through a frusto-conical piece, said vanes are uninfluenced by said tapered portion during the pumping action, and said vanes are maintained out of engagement with said housing bore by said jacket surface of larger diameter when the pumping action is terminated.

8. A positive-displacement pump in accordance with claim 2 including a holding apparatus for retaining said vane in position.

9. A positive-displacement pump in accordance with claim 8 wherein said locking means includes a member having an oblique face, a flat spring piece having a leg, said leg having an active end placed onto said oblique face in locking engagement therewith to thereby form said locking means.

10. A positive-displacement pump in accordance with claim 8 including a releasing member for releasing said locking means.

11. A positive-displacement pump in accordance with claim 1 wherein said locking means includes a detent for form-locking the vane in position for shutting off the pumping action.

12. A positive-displacement pump in accordance with claim 1 wherein said vane includes overstroke means contouring of the detent.

* * * * *